US011373823B2

(12) United States Patent
Sakai et al.

(10) Patent No.: US 11,373,823 B2
(45) Date of Patent: Jun. 28, 2022

(54) ELECTRIC CIRCUIT BREAKER DEVICE

(71) Applicant: DAICEL CORPORATION, Osaka (JP)

(72) Inventors: Toshiyuki Sakai, Tokyo (JP); Tomohide Fujiwara, Tokyo (JP)

(73) Assignee: DAICEL CORPORATION, Osaka (JP)

( * ) Notice: Subject to any disclaimer, the term of this patent is extended or adjusted under 35 U.S.C. 154(b) by 0 days.

(21) Appl. No.: 17/175,296

(22) Filed: Feb. 12, 2021

(65) Prior Publication Data

US 2021/0257172 A1 Aug. 19, 2021

(30) Foreign Application Priority Data

Feb. 14, 2020 (JP) ..... JP2020-023839

(51) Int. Cl.
*H01H 33/04* (2006.01)
*H01H 33/53* (2006.01)
*H01H 33/60* (2006.01)

(52) U.S. Cl.
CPC ..... *H01H 33/04* (2013.01); *H01H 33/53* (2013.01); *H01H 33/60* (2013.01)

(58) Field of Classification Search
CPC ..... H01H 33/04; H01H 33/53; H01H 33/60; H01H 9/30; H01H 39/00; H01H 39/006; H01H 39/002; H01H 2039/008
USPC ..... 218/155, 134, 139
See application file for complete search history.

(56) References Cited

U.S. PATENT DOCUMENTS

| | | | | |
|---|---|---|---|---|
| 5,808,253 | A | 9/1998 | Hatakeyama | |
| 9,704,681 | B2 * | 7/2017 | Fukuyama | H01H 39/006 |
| 9,905,383 | B2 * | 2/2018 | Hori | B60L 3/0007 |
| 10,431,406 | B2 | 10/2019 | Gaudinat et al. | |
| 2002/0106921 | A1 * | 8/2002 | Hirai | H01R 13/53 439/181 |
| 2014/0061161 | A1 * | 3/2014 | Nakamura | H01H 33/74 218/26 |
| 2017/0213676 | A1 | 7/2017 | Lell | |
| 2017/0221662 | A1 * | 8/2017 | Sakai | H01H 39/006 |

(Continued)

FOREIGN PATENT DOCUMENTS

| | | | |
|---|---|---|---|
| EP | 1 229 609 | A1 | 8/2002 |
| JP | 8-279327 | A | 10/1996 |

(Continued)

*Primary Examiner* — William A Bolton
(74) *Attorney, Agent, or Firm* — Birch, Stewart, Kolasch & Birch, LLP

(57) ABSTRACT

An electric circuit breaker device includes an igniter provided to a housing, a projectile disposed in a cylindrical space formed in the housing, the projectile being movably formed in the cylindrical space by energy received from the igniter, a conductor piece that is provided to the housing, forms a portion of an electric circuit, includes a cutoff portion to be cut off by the projectile in a portion thereof, and is disposed with the cutoff portion crossing the cylindrical space, an arc-extinguishing region positioned within the cylindrical space, on a side opposite to the projectile prior to actuation of the igniter with the cutoff portion interposed between the arc-extinguishing region and the projectile, and configured to receive the cutoff portion cut off by the projectile, and a coolant material having a fibrous form and disposed in the arc-extinguishing region.

4 Claims, 10 Drawing Sheets

(56) References Cited

U.S. PATENT DOCUMENTS

| | | | |
|---|---|---|---|
| 2017/0229266 | A1 | 8/2017 | Cortes et al. |
| 2020/0194204 | A1 | 6/2020 | Sakai |

FOREIGN PATENT DOCUMENTS

| | | | |
|---|---|---|---|
| JP | 2017-517134 | A | 6/2017 |
| JP | 2019-29152 | A | 2/2019 |
| JP | 2019-36481 | A | 3/2019 |
| JP | 2019-53907 | A | 4/2019 |
| JP | 2019-212612 | A | 12/2019 |

* cited by examiner

ELECTRIC CIRCUIT BREAKER DEVICE

CROSS-REFERENCE TO RELATED APPLICATION

This application claims the benefit of foreign priority to Japanese Patent Application No. 2020-023839, filed on Feb. 14, 2020, the entire contents of which are incorporated herein by reference.

TECHNICAL FIELD

The present invention relates to an electric circuit breaker device.

BACKGROUND ART

An electric circuit may be provided with a breaker device configured to be actuated when an abnormality occurs in a device constituting the electric circuit or when an abnormality occurs in a system in which the electric circuit is mounted, thereby urgently interrupting the continuity of the electric circuit. Electric circuit breaker devices have been proposed in which, according to one aspect thereof, a projectile is moved at high speed by energy applied from an igniter or the like to forcibly and physically cut a conductor piece that forms a portion of the electric circuit (refer to Patent Documents 1 to 6 and the like, for example). Further, in recent years, electric circuit breaker devices applied to electric vehicles equipped with a high-voltage power source are becoming increasingly important.

CITATION LIST

Patent Document

Patent Document 1: JP 2017-517134 A
Patent Document 2: JP 2019-212612 A
Patent Document 3: JP 08-279327 A
Patent Document 4: JP 2019-29152 A
Patent Document 5: JP 2019-36481 A
Patent Document 6: JP 2019-53907 A

SUMMARY OF INVENTION

Technical Problem

In an electric circuit breaker device, an arc is likely to occur when a conductor piece forming a portion of an electric circuit is cut. When an arc occurs, the electric circuit cannot be interrupted quickly, and thus the electric circuit breaker device must quickly extinguish the generated arc. The technique of the present disclosure has been made in view of the circumstances described above, and an object thereof is to provide an electric circuit breaker device capable of quickly extinguishing an arc that occurs during actuation.

Solution to Problem

In order to solve the problems described above, in the present disclosure, a coolant material having a fibrous form is arranged in an arc-extinguishing region formed in a housing of an electric circuit breaker device and configured to receive a cutoff portion of a conductor piece.

More specifically, an electric circuit breaker device according to the present disclosure includes an igniter provided to a housing, a projectile disposed in a cylindrical space formed in the housing, the projectile being movably formed in the cylindrical space by energy received from the igniter, a conductor piece that is provided to the housing, forms a portion of an electric circuit, includes a cutoff portion to be cut off by the projectile in a portion thereof, and is disposed with the cutoff portion crossing the cylindrical space, an arc-extinguishing region positioned within the cylindrical space, on a side opposite to the projectile prior to actuation of the igniter with the cutoff portion interposed between the arc-extinguishing region and the projectile, and configured to receive the cutoff portion cut off by the projectile, and a coolant material having a fibrous form and disposed in the arc-extinguishing region.

Here, the coolant material may be formed from a metal fiber material. Further, the coolant material may be formed from steel wool.

Further, the arc-extinguishing region may include a first arc-extinguishing region adjacent to the cutoff portion disposed crossing the cylindrical space prior to actuation of the igniter and a second arc-extinguishing region positioned on a side opposite to the cutoff portion with the first arc-extinguishing region interposed between the second arc-extinguishing region and the cutoff portion, the first arc-extinguishing region may have a width dimension in a transverse cross-sectional direction that corresponds to a width dimension in a transverse cross-sectional direction of the cutoff portion, and the second arc-extinguishing region may have a transverse cross-sectional area greater than a transverse cross-sectional area of the first arc-extinguishing region.

Advantageous Effects of Invention

According to the present disclosure, it is possible to provide an electric circuit breaker device capable of quickly extinguishing an arc that occurs during actuation.

DESCRIPTION OF EMBODIMENTS

An electric circuit breaker device according to an embodiment of the present disclosure will be described below with reference to the drawings. Note that each of the configurations, combinations thereof, and the like in the embodiment are an example, and various additions, omissions, substitutions, and other changes may be made as appropriate without departing from the spirit of the present disclosure. The present disclosure is not limited by the embodiments and is limited only by the claims.

First Embodiment

Figure 1:
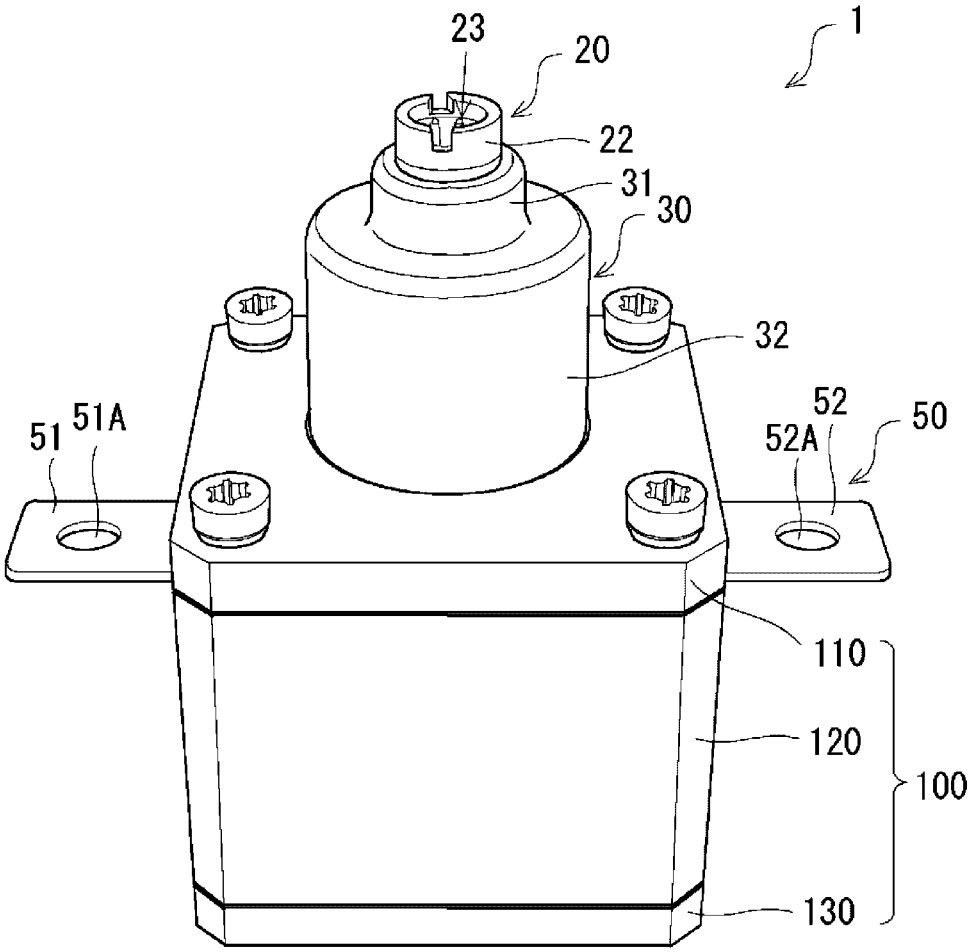
FIG. 1 is a perspective view of a breaker device.
Figure 2:
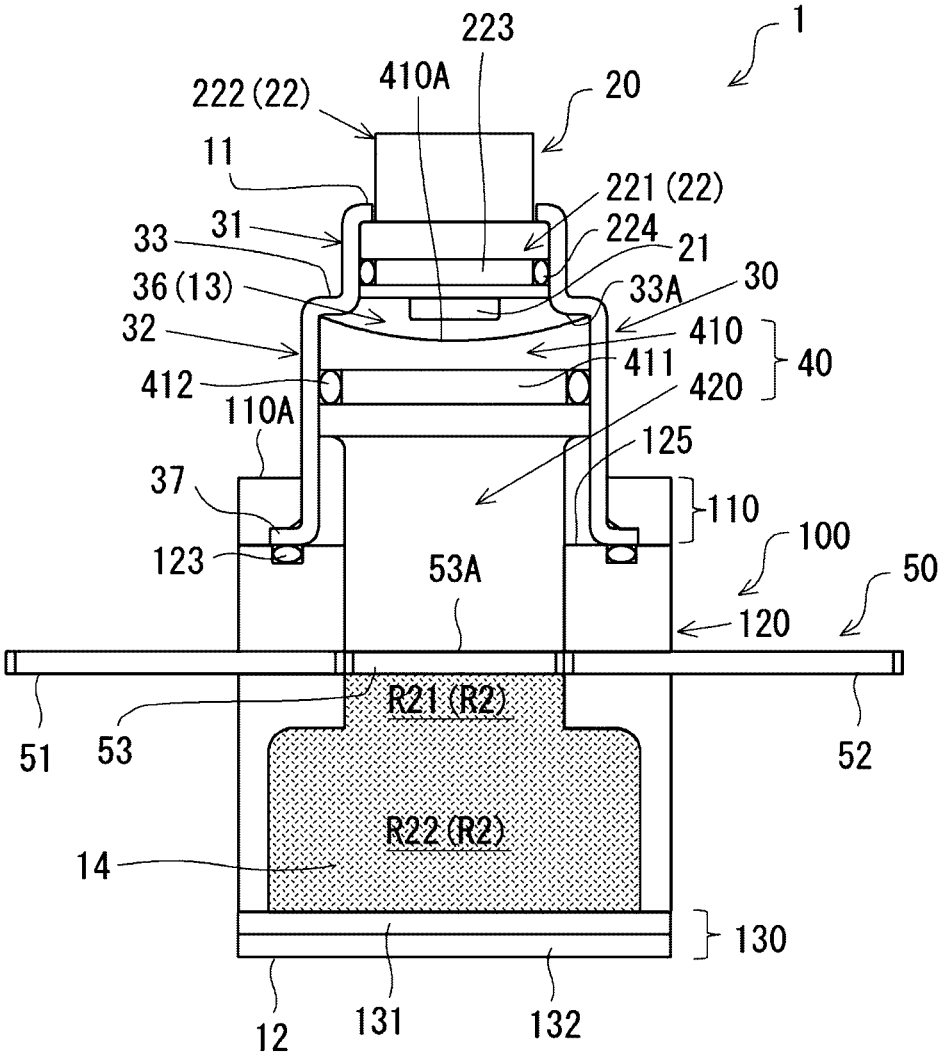
FIG. 2 is a drawing illustrating an internal structure of the breaker device.

FIG. 1 is a perspective view of an electric circuit breaker device (hereinafter simply referred to as "breaker device") 1. FIG. 2 is a drawing illustrating an internal structure of the breaker device 1 in a height direction (direction in which a cylindrical space 13 described later extends). The breaker device 1 is a device configured to interrupt an electric circuit included in a vehicle, an electric home appliance, or the like when an abnormality occurs in the electric circuit or in a system including a lithium battery (lithium ion battery, for example) of the electric circuit, thereby preventing great damage. In the present specification, a cross section of the breaker device 1 in the height direction (direction in which the cylindrical space 13 described later extends) is referred to as a vertical cross section of the breaker device 1, and a cross section in a direction orthogonal to the vertical cross section is referred to as a transverse cross section of the breaker device 1. Further, FIG. 2 illustrates a state prior to actuation of the breaker device 1.

Figure 3:
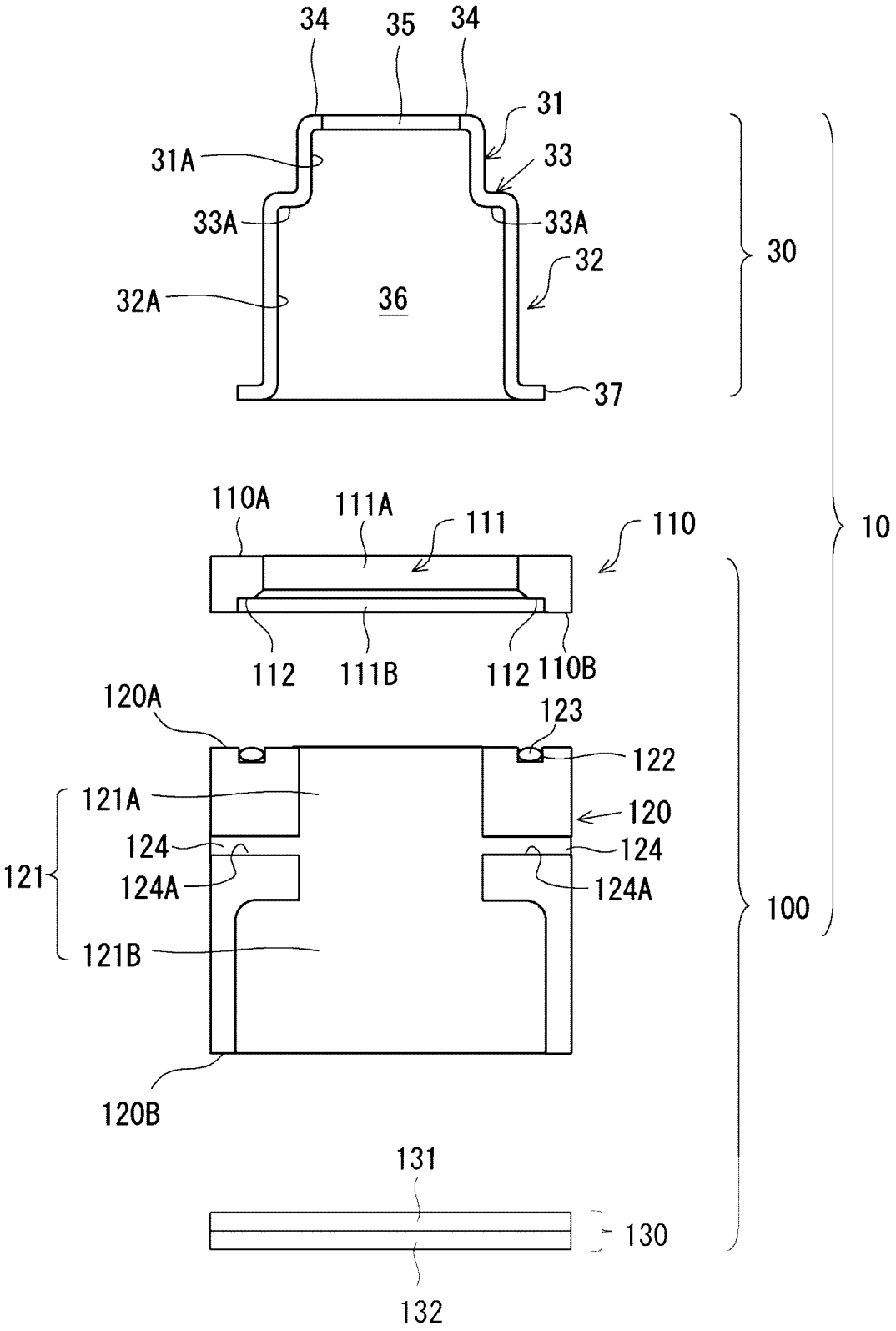
FIG. 3 is an exploded view of a housing.

The breaker device 1 includes a housing 10, an igniter 20, a projectile 40, a conductor piece 50, and the like. FIG. 3 is an exploded view of the housing 10. The housing 10 includes the cylindrical space 13 that extends in a direction from a first end portion 11 to a second end portion 12. This cylindrical space 13 is a space formed in a straight line, making the projectile 40 described later movable. Then, the igniter 20 is provided on the first end portion 11 side of the breaker device 1. The igniter 20 includes an ignition portion 21 with an ignition charge, and an igniter body 22 including a conduction pin 23 connected to the ignition portion 21. The igniter body 22 is surrounded by an insulating resin. Further, the conduction pin 23 of the igniter body 22 is exposed to the outside, and is connected to a power source when the breaker device 1 is used.

The housing 10 includes a housing body 100 and a cylinder 30 attached to an upper portion of the housing body 100. That is, an outer shell of the breaker device 1 is formed including the housing body 100 and the cylinder 30.

In the example illustrated in FIG. 1, the housing body 100 has a substantially rectangular parallelepiped shape as a whole. and includes, from the top, a top lid housing portion 110, a central housing portion 120, and a bottom lid housing portion 130. However, the shape of the housing body 100 is not particularly limited. Further, the top lid housing portion 110 and the central housing portion 120, and the central housing portion 120 and the bottom lid housing portion 130 are respectively fixed using known fasteners, for example, thereby integrating the housing body 100.

The central housing portion 120 is formed from an insulating member such as a synthetic resin or the like. For example, the central housing portion 120 may be formed from nylon, which is a type of polyamide synthetic resin. Further, the central housing portion 120 has a substantially prismatic shape.

The central housing portion 120 includes a cavity portion 121 formed therethrough in a vertical direction from an upper end surface 120A to a lower end surface 120B of the central housing portion 120. The cavity portion 121 includes a small diameter cavity portion 121A disposed on the upper end surface 120A side of the central housing portion 120, and a large diameter cavity portion 121B disposed on the lower end surface 120B side of the central housing portion 120. Both the small diameter cavity portion 121A and the large diameter cavity portion 121B are cavity portions of a cylindrical shape having a circular transverse cross section, and a diameter of the small diameter cavity portion 121A is smaller than a diameter of the large diameter cavity portion 121B. Further, the small diameter cavity portion 121A and the large diameter cavity portion 121B are coaxially disposed. Furthermore, in the central housing portion 120, a pair of conductor piece insertion portions 124 for inserting the conductor piece 50 are provided passing through the central housing portion 120 in a transverse cross-sectional direction.

The bottom lid housing portion 130 in the present embodiment is, for example, a flat plate member having a square outer shape corresponding to that of the central housing portion 120. Further, in the example illustrated in FIG. 3, the bottom lid housing portion 130 has a two-layer structure. More specifically, the bottom lid housing portion 130 has a layered structure in which an interior portion 131 facing the central housing portion 120 side and an exterior portion 132 facing the outside are integrally joined.

The interior portion 131 of the bottom lid housing portion 130, similar to the central housing portion 120, is formed from an insulating member such as a synthetic resin. The interior portion 131, similar to the central housing portion 120, may also be formed from nylon, which is a type of polyamide synthetic resin. Further, the exterior portion 132 of the bottom lid housing portion 130 is formed from an appropriate metal member, such as stainless steel or aluminum, having excellent strength and durability. However, the mode described above of the bottom lid housing portion 130 is exemplary. For example, the bottom lid housing portion 130 as a whole may be formed from an insulating member.

The top lid housing portion 110 is, for example, a member having a square outer shape corresponding to that of the central housing portion 120. As illustrated in FIG. 3, a cavity portion 111 for pressing the cylinder 30 is formed in the vertical direction, from an upper end 110A to a lower end 110B, at a transverse cross-sectional center of the top lid housing portion 110. The top lid housing portion 110, similar to the exterior portion 132 of the bottom lid housing portion 130, is formed from an appropriate metal member, such as stainless steel or aluminum, having excellent strength and durability. The cavity portion 111 of the top lid housing portion 110 includes a small diameter cavity portion 111A disposed on the upper end 110A side of the top lid housing portion 110, and a large diameter cavity portion 111B disposed on the lower end 110B side of the top lid housing portion 110. Both the small diameter cavity portion 111A and the large diameter cavity portion 111B are cavity portions having a circular transverse cross section, and a diameter of the small diameter cavity portion 111A is smaller than a diameter of the large diameter cavity portion 111B. Further, the small diameter cavity portion 111A and the large diameter cavity portion 111B of the top lid housing portion 110 are coaxially disposed. Furthermore, a stepped surface 112 extending in the transverse cross-sectional direction of the top lid housing portion 110 and caused by these diameter differences is formed at a boundary portion between the small diameter cavity portion 111A and the large diameter cavity portion 111B.

Next, details of the cylinder 30 will be described. The cylinder 30 is a cylindrical member having a stepped cylindrical shape, and an upper end side and a lower end side are both formed as open ends. The cylinder 30, similar to the top lid housing portion 110 and the like, is formed from an appropriate metal member, such as stainless steel or aluminum, having excellent strength and durability.

When described in greater detail, the cylinder 30 includes a small diameter portion 31 disposed on the upper end side, a large diameter portion 32 disposed on the lower end side, and a stepped portion 33 that connects these. The small diameter portion 31 and the large diameter portion 32 each have a substantially cylindrical shape, and a diameter of the small diameter portion 31 is smaller than a diameter of the large diameter portion 32. The small diameter portion 31 and the large diameter portion 32 of the cylinder 30 are coaxially disposed with a center axis extending in the vertical direction, and the stepped portion 33 extends in the transverse cross-sectional direction (radial direction) of the cylinder 30. Further, reference sign 33A denotes an inner wall surface of the stepped portion 33.

Reference sign 31A indicated in FIG. 3 denotes an inner circumferential surface of the small diameter portion 31. As illustrated in FIG. 2, in the small diameter portion 31 of the cylinder 30, the igniter 20 is pressed to the inner circumferential surface 31A, thereby fixing the igniter 20 to the small diameter portion 31, for example. Furthermore, an upper end side of the small diameter portion 31 of the cylinder 30 is formed folded toward an inner side in the radial direction, for example, and thus an upper end collar portion 34 is formed on the upper end side of the small diameter portion 31. An edge portion of the upper end collar portion 34 has an annular shape, and an opening 35 is formed on an inner side thereof.

Here, as illustrated in FIG. 2, the igniter body 22 of the igniter 20 includes a body portion 221 having a cylindrical shape and housed in the small diameter portion 31 of the cylinder 30, and a connector portion 222 exposed to the outside of the cylinder 30 (housing 10) through the opening 35. The body portion 221 of the igniter 20 is pressed to the inner circumferential surface 31A of the small diameter portion 31 of the cylinder 30, and thus fixed to the inner circumferential surface 31A. More specifically, the body portion 221 of the igniter 20 has an outer diameter of an intermediate portion in the vertical direction that is slightly small compared to other locations, and a constricted portion 223 is formed as an annular recess due to this difference in outer diameters. An O-ring 224 made of rubber (silicone rubber, for example) or a synthetic resin is fitted into the constricted portion 223 of the body portion 221, thereby increasing airtightness between the inner circumferential surface 31A of the cylinder 30 and the body portion 221 of the igniter 20. Further, the connector portion 222 of the igniter 20 has a cylindrical shape covering a side of the conduction pin 23, as illustrated in FIG. 1, allowing connection with a connector of a power source.

Next, details of the large diameter portion 32 of the cylinder 30 will be described. Reference sign 32A indicated in FIG. 3 denotes an inner circumferential surface of the small diameter portion 32. As illustrated in FIG. 2, a piston portion 410 of the projectile 40 is slidably disposed along the inner circumferential surface 32A on an inner side of the large diameter portion 32 of the cylinder 30. Further, as illustrated in FIG. 2 and FIG. 3, a lower end side of the large diameter portion 32 of the cylinder 30 is formed folded toward an outer side in the radial direction, for example, and thus a lower end collar portion 37 is formed on the lower end side of the large diameter portion 32. Here, an outer diameter of the large diameter portion 32 of the cylinder 30 is equal to the diameter of the small diameter cavity portion 111A of the top lid housing portion 110. Further, an outer diameter of the lower end collar portion 37 of the cylinder 30 is equal to the diameter of the large diameter cavity portion 111B of the top lid housing portion 110. In the breaker device 1 according to the present embodiment, the lower end collar portion 37 of the cylinder 30 is disposed in the large diameter cavity portion 111B of the top lid housing portion 110, and the cylinder 30 is assembled to the housing body 100 with the lower end collar portion 37 engaged with the stepped surface 112 of the top lid housing portion 110. As a result, the cylinder 30 is integrally fixed to the housing body 100. Note that an inner diameter of the large diameter portion 32 of the cylinder 30 is larger than the diameter of the small diameter cavity portion 121A of the central housing portion 120.

Further, a groove portion 122 having an annular shape is formed in the upper end surface 120A of the central housing portion 120, and an O-ring 123 made of rubber (silicone rubber, for example) or a synthetic resin is fitted into this groove portion 122 in a state of abutting the lower end collar portion 37 of the cylinder 30. When the cylinder 30 is assembled to the housing body 100, the O-ring 123 disposed in the groove portion 122 of the central housing portion 120 is compressed by the lower end collar portion 37 of the cylinder 30, thereby further increasing the airtightness between the cylinder 30 and the housing body 100. Further, a region of the upper end surface 120A of the central housing portion 120 that faces the inner side of the large diameter portion 32 of the cylinder 30 is referred to as a stopper portion 125.

Figure 4:
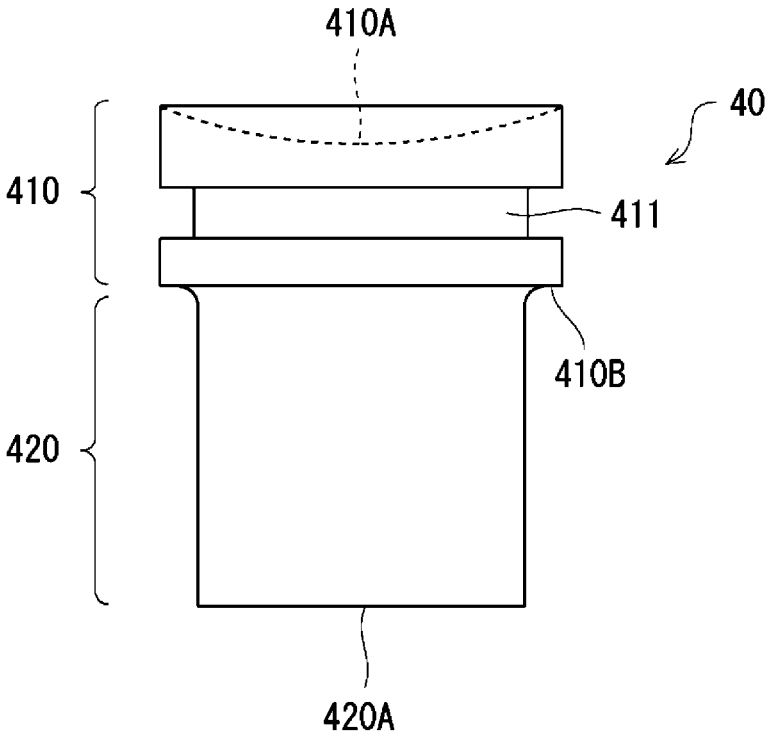
FIG. 4 is a side view of a projectile.

Next, the details of the projectile 40 will be described. FIG. 4 is a side view of the projectile 40. The projectile 40 is formed from an insulating member, such as a synthetic resin, and includes the piston portion 410 and a rod portion 420 having a rod shape and connected to the piston portion 410. Both the piston portion 410 and the rod portion 420 are substantially cylindrical bodies, and an outer diameter of the piston portion 410 is greater than an outer diameter of the rod portion 420. Further, the piston portion 410 and the rod portion 420 of the projectile 40 are coaxially disposed. Further, reference sign 410A indicated in FIG. 4 denotes an upper end surface of the piston portion 410, and reference sign 410B denotes a lower end surface of the piston portion 410. The upper end surface 410A of the piston portion 410 has a recessed curved shape with a center portion in a planar direction being the deepest. However, the shape of the upper end surface 410A of the piston portion 410 is not limited to the mode described above, and may be formed as a flat surface.

Further, reference sign 420A denotes a lower end surface of the rod portion 420. The upper end surface 410A of the piston portion 410 can be referred to as an upper end surface of the projectile 40, and the lower end surface 420A of the rod portion 420 can be referred to as a lower end surface of the projectile 40. In the following, the vertical direction illustrated in FIG. 4 is defined as the vertical direction of the projectile 40. The vertical direction of the projectile 40 coincides with an axial direction of the piston portion 410 and the rod portion 420. Further, of the rod portion 420 of the projectile 40, the side connected to the piston portion 410 may be referred to as a base end side, and the opposite side, that is, the side where the lower end surface 420A is positioned, may be referred to as a tip end side.

The outer diameter of the piston portion 410 is slightly smaller than the inner diameter of the large diameter portion 32 of the cylinder 30. Further, the piston portion 410 has an outer diameter of an intermediate portion in the vertical direction that is formed slightly small compared to other locations, and a constricted portion 411 is formed as an annular recess due to this difference in outer diameters. An O-ring 412 made of rubber (silicone rubber, for example) or a synthetic resin is fitted into the constricted portion 411 of the piston portion 410. In the state illustrated in FIG. 2, the O-ring 412 fitted into the constricted portion 411 of the piston portion 410 abuts the inner circumferential surface 32A of the large diameter portion 32 of the cylinder 30, and is thereby compressed. Thus, an appropriate sealing property is exhibited by the O-ring 412. Further, the outer diameter of the rod portion 420 of the projectile 40 is slightly smaller than the diameter of the small diameter cavity portion 121A in the central housing portion 120.

Figure 5:
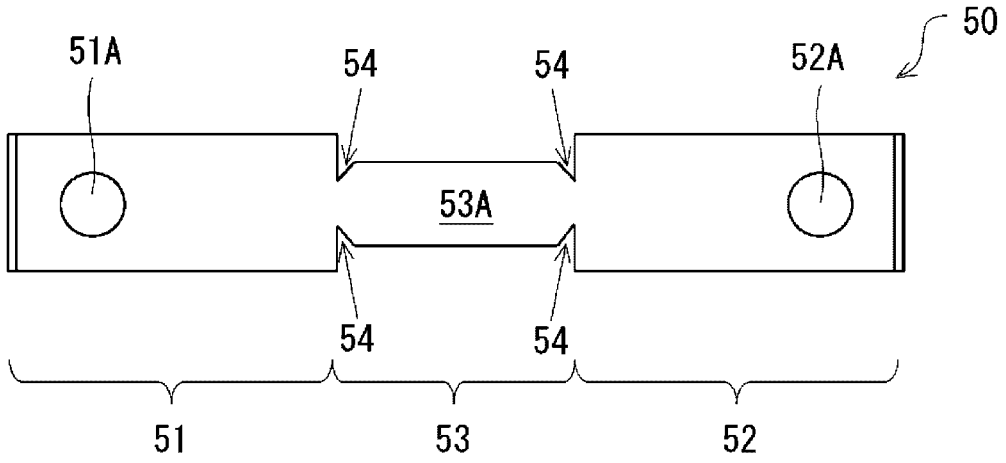
FIG. 5 is a plan view of a conductor piece.

Next, details of the conductor piece 50 will be described. FIG. 5 is a plan view of the conductor piece 50. The conductor piece 50 is a metal body having conductivity that constitutes a portion of the components of the breaker device 1 and, when the breaker device 1 is attached to a predetermined electric circuit, forms a portion of the electric circuit, and may be referred to as a bus bar. The conductor piece 50 can be formed from a metal such as copper (Cu), for example. However, the conductor piece 50 may be formed from a metal other than copper, or may be formed from an alloy of copper and another metal. Note that examples of metals other than copper included in the conductor piece 50 include manganese (Mn), nickel (Ni), and platinum (Pt).

In the example illustrated in FIG. 5, the conductor piece 50 is formed as an elongated flat plate piece as a whole, and includes a first connecting end portion 51 and a second connecting end portion 52 on both end sides, a cutoff portion 53 positioned in an intermediate portion therebetween, and the like. Connection holes 51A, 52A are provided in the first connecting end portion 51 and the second connecting end portion 52 of the conductor piece 50, respectively. These connection holes 51A, 52A are used to connect with other conductors (lead wires, for example) in the electric circuit. The cutoff portion 53 of the conductor piece 50 is a portion forcibly and physically cut by the rod portion 420 of the projectile 40 and is cut off from the first connecting end portion 51 and the second connecting end portion 52 when an abnormality such as excessive current occurs in the electric circuit to which the breaker device 1 is applied. Notches (slits) 54 are formed at both ends of the cutoff portion 53 of the conductor piece 50, making it easy to cut and cut off the cutoff portion 53.

Here, various forms of the conductor piece 50 can be adopted, and a shape thereof is not particularly limited. While, in the example illustrated in FIG. 5, surfaces of the first connecting end portion 51, the second connecting end portion 52, and the cutoff portion 53 form the same surface, the form is not limited thereto. For example, the conductor piece 50 may be connected such that the cutoff portion 53 is orthogonal to or inclined relative to the first connecting end portion 51 and the second connecting end portion 52. Further, the planar shape of the cutoff portion 53 of the conductor piece 50 is not particularly limited, either. Of course, the shapes of the first connecting end portion 51 and the second connecting end portion 52 of the conductor piece 50 are not particularly limited, either.

The conductor piece 50 configured as described above is inserted through the pair of conductor piece insertion portions 124 provided to the central housing portion 120 of the housing body 100, and is thus held in the central housing portion 120 in a state of crossing the small diameter cavity portion 121A of the central housing portion 120 (refer to FIG. 2). Note that, in the central housing portion 120 of the housing body 100, the conductor piece 50 is mounted on mounting surfaces 124A that define lower surfaces of the pair of conductor piece insertion portions 124 (refer to FIG. 3). Each of the mounting surfaces 124A of the pair of conductor piece insertion portions 124 is formed as a flat surface extending in a direction orthogonal to the extending direction (axial direction) of the cylindrical space 13. Therefore, when the first connecting end portion 51 and the second connecting end portion 52 of the conductor piece 50 are respectively mounted on the mounting surfaces 124A provided to the central housing portion 120, the conductor piece 50 crosses the cylindrical space 13 and is held in a manner orthogonal to the extending direction (axial direction) of the cylindrical space 13.

Figure 6:
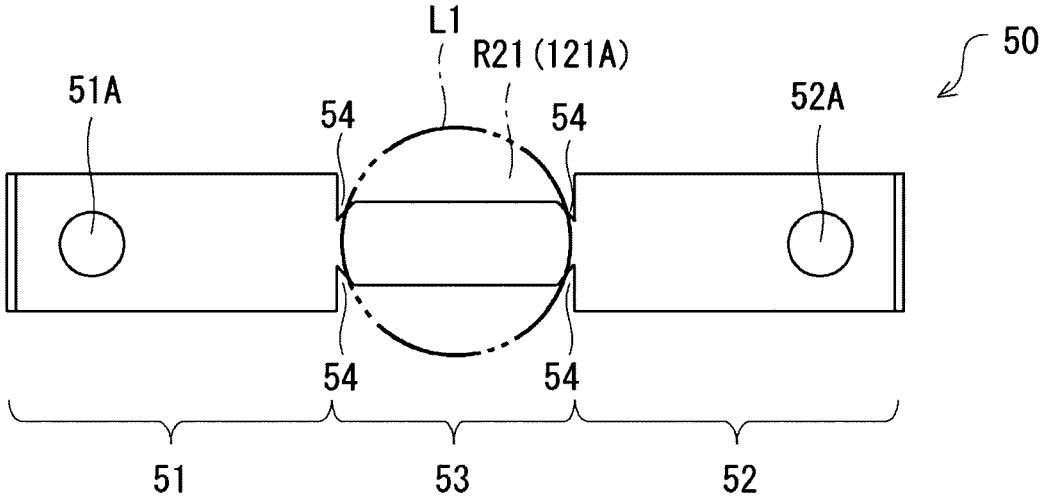
FIG. 6 is a diagram illustrating a planar positional relationship between a small diameter cavity portion and the conductor piece in a state where the conductor piece is installed in the breaker device.

Note that FIG. 6 is a diagram illustrating a planar positional relationship between the small diameter cavity portion 121A and the conductor piece 50 in a state where the conductor piece 50 is disposed in the central housing portion 120 of the breaker device 1. As illustrated in FIG. 6, the conductor piece 50 is disposed in the central housing portion 120 in such a manner that the cutoff portion 53 is included in the region of the small diameter cavity portion 121A. Further, the conductor piece 50 is disposed with an outer edge L1 (illustrated in FIG. 6) of the small diameter cavity portion 121A of the central housing portion 120 planarly overlapping the positions of the notches 54 of the conductor piece 50.

Figure 7:
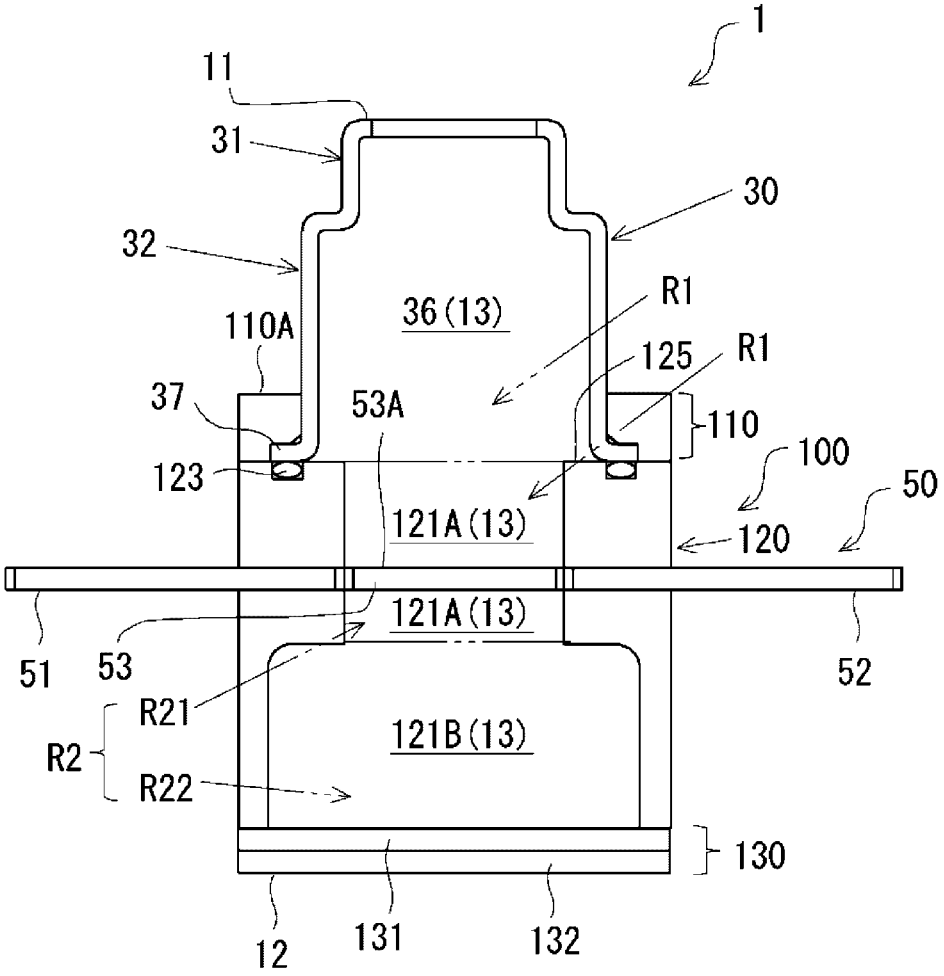
FIG. 7 is a diagram illustrating the internal structure of the breaker device.

Returning to FIG. 2 and FIG. 3, the configuration of the breaker device 1 will be described. In the cylindrical space 13 formed in the housing 10, the igniter 20, the projectile 40, and the conductor piece 50 are disposed in this order from the first end portion 11 side in the vertical direction of the breaker device 1. Further, FIG. 7 is a diagram illustrating an internal structure of the breaker device 1 in a height direction (direction in which the cylindrical space 13 described later extends), without the projectile 40 being illustrated for the sake of convenience. In the breaker device 1 according to the present embodiment, the cylindrical space 13 of the housing 10 is formed by respectively connecting, in the vertical direction, a cylinder cavity portion 36 formed inside the large diameter portion 32 of the cylinder 30, and the small diameter cavity portion 121A and the large diameter cavity portion 121B of the housing body 100 (central housing portion 120). That is, the cylindrical space 13 is configured to include the cylinder cavity portion 36, the small diameter cavity portion 121A, and the large diameter cavity portion 121B of the breaker device 1.

As illustrated in FIG. 2, FIG. 7, and the like, the ignition portion 21 of the igniter 20 is disposed facing the inside of the cylindrical space 13 (more specifically, the cylinder cavity portion 36) of the housing 10. Accordingly, when the igniter 20 is actuated, a combustion product generated by the combustion of the ignition charge of the igniter 21 is discharged into the cylindrical space 13 (cylinder cavity portion 36). Further, as illustrated in FIG. 2, the projectile 40 is housed in the cylindrical space 13 of the housing 10 with the piston portion 410 positioned on an upper side and the rod portion 420 positioned on a lower side. Specifically, the upper end surface 410A of the piston portion 410 of the projectile 40 is disposed facing the ignition portion 21 of the igniter 20.

Further, in the breaker device 1, a length of the projectile 40 in the axial direction is configured to be substantially equal to a separation distance in the vertical direction of the housing 10 between an upper surface 53A (refer to FIG. 2, FIG. 7, and the like) of the cutoff portion 53 of the conductor piece 50 installed in the housing 10 and the stepped portion 33 of the cylinder 30. Thus, prior to actuation of the breaker device 1 (igniter 20), the projectile 40 is positioned in the cylindrical space 13 with an outer circumferential edge of the upper end surface 410A of the piston portion 410 of the projectile 40 abutting the inner wall surface 33A of the stepped portion 33 of the cylinder 30, and the lower end surface 420A of the rod portion 420 abutting the upper surface 53A of the cutoff portion 53 of the conductor piece 50. Hereinafter, the position of the projectile 40 thus positioned is referred to as an "initial position". However, in this initial position, the lower end surface 420A of the rod portion 420 of the projectile 40 and the upper surface 53A of the cutoff portion 53 of the conductor piece 50 may be disposed facing each other with a gap therebetween.

Further, prior to actuation of the breaker device 1 (igniter 20), the cylindrical space 13 of the housing 10 is vertically separated (divided into two parts) by the conductor piece 50 (cutoff portion 53) disposed crossing the cylindrical space 13. Hereinafter, within the cylindrical space 13 of the housing 10 separated by the cutoff portion 53 of the conductor piece 50, a region (space) in which the projectile 40 is disposed is referred to as a "projectile initial arrangement region R1" (refer to FIG. 7), and a region (space) positioned on the opposite side of the projectile 40 is referred to as an "arc-extinguishing region R2" (refer to FIG. 7). As is clear from FIG. 7 and the like, the arc-extinguishing region R2 in the cylindrical space 13 of the present embodiment is formed as an insulating closed space including the whole large diameter cavity portion 121B and a portion of the small diameter cavity portion 121A.

Further, within the arc-extinguishing region R2, a region formed by the small diameter cavity portion 121A is referred to as a "first arc-extinguishing region R21", and a region formed by the large diameter cavity portion 121B is referred to as a "second arc-extinguishing region R22". Here, the first arc-extinguishing region R21 is a region adjacent to the cutoff portion 53 of the conductor piece 50 disposed crossing the cylindrical space 13 prior to actuation of the igniter 20, and extends above the second arc-extinguishing region R22. Further, the second arc-extinguishing region R22 is a region positioned on the opposite side of the cutoff portion 53 with the first arc-extinguishing region R21 interposed between the second arc-extinguishing R22 and the cutoff portion 53, and extends below the first arc-extinguishing region R21. In the present embodiment, a transverse cross-sectional area of the second arc-extinguishing region R22 is greater than a transverse cross-sectional area of the first arc-extinguishing region R21. More specifically, a width dimension of the first arc-extinguishing region R21 in the transverse cross-sectional direction (corresponding to a diameter of the first arc-extinguishing region R21 (small diameter cavity portion 121A) in the present embodiment) corresponds to a width dimension of the cutoff portion 53 in the transverse cross-sectional direction, and the transverse cross-sectional area of the second arc-extinguishing region R22 is greater than the transverse cross-sectional area of the first arc-extinguishing region R21.

In the present embodiment, the arc-extinguishing region R2 of the breaker device 1 has significance as a space for receiving the cutoff portion 53 cut off from the first connecting end portion 51 and the second connecting end portion 52 of the conductor piece 50 by the projectile 40 and, at the same time, as a space for effectively extinguishing the arc generated when the projectile 40 cuts off the cutoff portion 53. Then, in order to effectively extinguish the arc generated when the cutoff portion 53 is cut off from the conductor piece 50, in the present embodiment, the arc-extinguishing region R2 is filled with a coolant material having a fibrous form (hereinafter referred to as a "fibrous coolant material") 14 as an arc-extinguishing material (refer to FIG. 2). The fibrous coolant material 14 is a coolant material having a fibrous form that removes thermal energy of the arc generated and the cutoff portion 53 when the projectile 40 cut off the cutoff portion 53, and cools the arc and the cutoff portion 53. While the type of the fibrous coolant material 14 is not particularly limited, steel wool is employed as the fibrous coolant material 14 in the present embodiment. Note that, in FIG. 2, for the sake of convenience, a range of the fibrous coolant material 14 disposed in the arc-extinguishing region R2 is indicated by hatching. While, in FIG. 2, a mode is illustrated in which the arc-extinguishing region R2 is entirely filled with the fibrous coolant material 14, the fibrous coolant material 14 may be disposed occupying a portion of the arc-extinguishing region R2. For example, the fibrous coolant material 14 may be disposed only in the second arc-extinguishing region R22 of the arc-extinguishing region R2, and the first arc-extinguishing region R21 may be a cavity. Of course, the mode of installation of the fibrous coolant material 14 in the arc-extinguishing region R2 is not limited to these examples, and various modes can be adopted.

The breaker device 1 configured as described above includes an abnormality detection sensor (not illustrated) configured to detect an abnormal current of the electric circuit, and a control unit (not illustrated) configured to control the actuation of the igniter 20. In addition to the current flowing through the conductor piece 50, the abnormality detection sensor may be capable of detecting a voltage and a temperature of the conductor piece 50. Further, the control unit is a computer capable of performing a predetermined function by executing a predetermined control program, for example. The predetermined function of the control unit may be realized by corresponding hardware. Then, when excessive current flows through the conductor piece 50 forming a portion of the electric circuit to which the breaker device 1 is applied, the abnormal current is detected by the abnormality detection sensor. The detected abnormal current is passed from the abnormality detection sensor to the controller. For example, the control unit is energized from an external power source (not illustrated) connected to the conduction pin 23 and actuates the igniter 20 based on the current value detected by the abnormality detection sensor. Here, the abnormal current may be a current value that exceeds a predetermined threshold value set for protection of a predetermined electric circuit. Note that the abnormality detection sensor and the control unit described above need not be included in the components of the breaker device 1, and may be included in a device separate from the breaker device 1, for example. Further, the abnormality detection sensor and the control unit are not essential components of the breaker device 1.

When the igniter 20 is actuated, the ignition charge of the ignition portion 21 burns, and a combustion product, such as a combustion gas and flame, is discharged into the cylindrical space 13 (cylinder cavity portion 36). A pressure (combustion energy) of the combustion product discharged from the ignition portion 21 into the cylindrical space 13 (cylinder cavity portion 36) is communicated to the upper end surface 410A of the piston portion 410 of the projectile 40 disposed near and facing the ignition portion 21 in the initial position. As a result, the projectile 40 moves downward through the cylindrical space 13 in the extending direction (axial direction) of the cylindrical space 13, and the rod portion 420 pressingly cuts the cutoff portion 53 from the conductor piece 50, thereby cutting off the cutoff portion 53. Here, the upper end surface 410A of the piston portion 410 of the projectile 40 has a recessed curved shape with a center portion in the planar direction being the deepest. Therefore, when the igniter 20 is actuated, the pressure of the combustion product discharged from the ignition portion 21 to the cylindrical space 13 (cylinder cavity portion 36) is readily received by the upper end surface 410A of the piston portion 410, making it possible to cause the lower end surface 420A of the rod portion 420 of the projectile 40 to vigorously collide with the cutoff portion 53 and cut off the cutoff portion 53.

Upon actuation of the igniter 20, the piston portion 410 of the projectile 40 is guided to the inner circumferential surface 32A of the large diameter portion 32 of the cylinder 30, and moves downwardly along the inner circumferential surface 32A in the projectile initial arrangement region R1 (cylinder cavity portion 36) of the cylindrical space 13. At this time, while the O-ring 412 fitted into the constricted portion 411 of the piston portion 410 is in contact with the inner circumferential surface 32A of the cylinder 30, an outer circumferential surface of the piston portion 410 other than the O-ring 44 is in completely non-contact with the inner circumferential surface 32A of the cylinder 30. Further, an outer circumferential surface of the rod portion 420 of the projectile 40 is in completely non-contact with an inner circumferential surface of the small diameter cavity portion 121A of the central housing portion 120. Thus, upon actuation of the igniter 20, the projectile 40 can be moved smoothly along the extending direction (axial direction) of the cylindrical space 13 (projectile initial arrangement region R1), and the cutoff portion 53 of the conductor piece 50 can be suitably cut off. However, as long as the projectile 40 can be moved smoothly in the extending direction (axial direction) of the cylindrical space 13 when the igniter 20 is actuated, the shape and the dimensions of the projectile 40 can be freely determined, and the outer diameter of the piston portion 410 of the projectile 40 may be set to a dimension equal to the inner diameter of the large diameter portion 32 of the cylinder 30, for example. Similarly, the outer diameter of the rod portion 420 of the projectile 40 may be set to a dimension equal to the diameter of the small diameter cavity portion 121A of the central housing portion 120.

Figure 8:
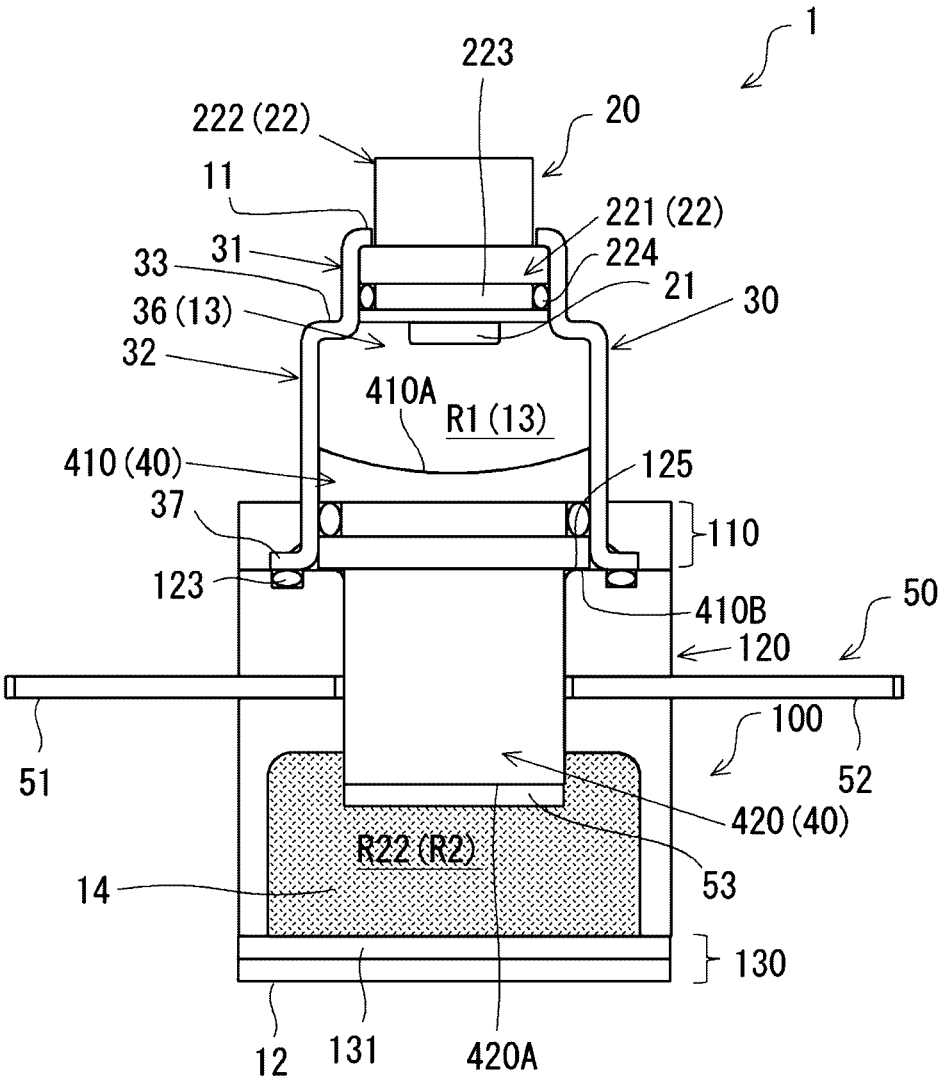
FIG. 8 is a diagram illustrating a state after actuation of an igniter of the breaker device.

The projectile 40 moves downward in the extending direction (axial direction) of the cylindrical space 13 until the lower end surface 410B of the piston portion 410 abuts (collides with) the stopper portion 125 of the central housing portion 120. FIG. 8 is a diagram illustrating a state after actuation of the igniter 20 of the breaker device 1. In the state illustrated in FIG. 8, the lower end surface 410B of the piston portion 410 of the projectile 40 abuts the stopper portion 125 of the central housing portion 120, thereby positioning the projectile 40. With actuation of the igniter 20, the cutoff portion 53, which has been cut off from the conductor piece 50 by the rod portion 420 of the projectile 40, moves along with a tip end portion of the rod portion 420 into the arc-extinguishing region R2, which is an insulating closed space, is received by the arc-extinguishing region R2, and is thus held electrically isolated. Thus, the first connecting end portion 51 and the second connecting end portion 52 positioned on both ends of the conductor piece 50 are electrically disconnected, and the predetermined electric circuit to which the breaker device 1 is applied is forcibly interrupted.

In the breaker device 1 of the present embodiment, the fibrous coolant material 14 is disposed in the arc-extinguishing region R2. Therefore, at the moment when the cutoff portion 53 of the conductor piece 50 is cut off from the first connecting end portion 51 and the second connecting end portion 52 by the rod portion 420 of the projectile 40, the cutoff portion 53 can be instantaneously buried in the fibrous coolant material 14 in the arc-extinguishing region R2 and quenched by the fibrous coolant material 14. Thus, when the cutoff portion 53 is cut off from the conductor piece 50 constituting a portion of the predetermined electric circuit, the occurrence of the arc can be effectively suppressed. Further, when the electric circuit is interrupted by the breaker device 1, even in a case where an arc is generated at the cut surface of the cutoff portion 53 of the conductor piece 50, the generated arc can be quickly and effectively extinguished. This makes it possible to quickly interrupt the electric circuit to which the breaker device 1 is applied in a case where an abnormality is detected in the electric circuit, or the like. That is, by effectively suppressing a prolonged extinguishing of the arc generated when the electric circuit is interrupted, it is possible to suppress a prolonged interruption of the electric circuit. Further, according to the breaker device 1, it is possible to suitably suppress the generation of a large spark or flame or the generation of a loud impact sound when the electric circuit is interrupted. Further, damage to the housing 10 and the like of the breaker device 1 caused by these can also be suppressed.

Further, as is clear in FIG. 8, the breaker device 1 has a relative relationship between a stroke length of the piston portion 410 of the projectile 40, a length of the first arc-extinguishing region R21 in the axial direction, and the like, causing the cutoff portion 53 cut off by the projectile 40 when the igniter 20 is actuated to be received in the second arc-extinguishing region R22 positioned below the first arc-extinguishing region R21. Thus, when the igniter 20 is actuated, the cutoff portion 53 is moved to the second arc-extinguishing region R22 having a large transverse cross-sectional area compared to that of the cutoff portion 53, making it possible to more favorably cover a periphery of the cutoff portion 53, particularly the cut surface of the cutoff portion 53, with the fibrous coolant material 14, and thus effectively remove the thermal energy from the cut surface of the cutoff portion 53. As a result, the arc can be more rapidly extinguished.

Further, since the breaker device 1 according to the present embodiment employs the fibrous coolant material 14 as the arc-extinguishing material disposed in the arc-extinguishing region R2 of the cylindrical space 13 of the housing 10, the breaker device 1 has the following advantages compared to a case where, for example, a powdered or granular arc-extinguishing material is employed. That is, moderate gaps are formed between fibers of the fibrous coolant material 14, and thus the cutoff portion 53 cut off from the conductor piece 50 upon actuation of the igniter 20 and the tip end portion of the rod portion 420 can be readily pressed into the fibrous coolant material 14 and the cutoff portion 53 can be smoothly buried in the fibrous coolant material 14. The periphery of the cutoff portion 53 received in the arc-extinguishing region R2 is surrounded by the fibrous coolant material 14, and thus the cutoff portion 53 can be cooled more quickly, thereby allowing the arc to be more effectively extinguished.

Furthermore, because of the fibrous coolant material 14, it is unlikely that an abnormal sound occurs even in a case where, for example, the breaker device 1 oscillates due to vibration or the like. For example, in a case where the breaker device 1 is mounted on a vehicle, the breaker device 1 is used in an environment that is subjected to vibration. In such an environment as well, the occurrence of a sound from the breaker device 1 that is unpleasant for the user can be suitably suppressed. In contrast, suppose a case where the arc-extinguishing region R2 of the breaker device 1 is filled with a powdered or granular arc-extinguishing material, the powdered or granular arc-extinguishing material readily moves in the arc-extinguishing region R2, and thus a so-called swishing sound is likely to occur. In particular, electric vehicles do not generate engine noise during travel and are excellent in quietness, and thus there is a risk that the swishing sound caused by the movement of the arc-extinguishing material within the housing will cause discomfort to the user. Further, in a case where the arc-extinguishing region R2 of the breaker device 1 is filled with a powdered or granular arc-extinguishing material as the arc-extinguishing material, the particles constituting the arc-extinguishing material rub against each other, resulting in a decrease in particle size over time and presumably failure to exhibit the desired arc-extinguishing performance in some cases. In contrast, because of the fibrous coolant material 14 in the present embodiment, the arc-extinguishing performance does not readily change over time, making it possible to constantly exhibit the desired arc-extinguishing performance.

On the other hand, from the viewpoint of suppressing the occurrence of an unpleasant sound such as described above, it is conceivable to fill the housing with a powdered or granular arc-extinguishing material by pressing the powdered or granular arc-extinguishing material. Nevertheless, with such a mode, although occurrences of the unpleasant sound can be suppressed, as a trade-off, when the igniter 20 is actuated, it becomes difficult to press the cutoff portion 53 cut off from the conductor piece 50 and the tip end portion of the rod portion 420 into the arc-extinguishing material, and the arc-extinguishing performance may deteriorate. In contrast, according to the fibrous coolant material 14 of the present embodiment, there is no such concern. As described above, in the present embodiment, it is possible to realize a breaker device 1 that has excellent arc-extinguishing performance and quietness performance, and is unlikely to deteriorate in arc-extinguishing performance over time.

Note that the fibrous coolant material 14 with which the arc-extinguishing region R2 of the housing 10 is filled is excellent in thermal conductivity, and preferably a fiber material that rapidly removes the thermal energy from the arc generated and the cutoff portion 53 when the projectile 40 cuts off the cutoff portion 53 is used. Examples of such a fiber material include a metal fiber material. Further, steel wool can be suitably used as the metal fiber material constituting the fibrous coolant material 14. However, as long as the cutoff portion 53 received in the arc-extinguishing region R2 of the housing 10 can be quenched as described above, it is not necessary to employ a metal fiber material as the fibrous coolant material 14.

Note that the breaker device 1 in the embodiment described above can adopt various modifications. For example, in the embodiment described above, a mode in which the housing body 100 is constituted by the top lid housing portion 110, the central housing portion 120, and the bottom lid housing portion 130 is described as an example. However, the mode is not limited thereto. Further, the shape, the size, and the like of the various components constituting the breaker device 1 can also be changed as appropriate. For example, in the embodiment described above, a case in which the rod portion 420 of the projectile 40 has a cylindrical shape is described as an example, but the rod portion 420 is not limited thereto and may have, for example, a prismatic shape. In this case, the transverse cross-sectional shape of the small diameter cavity portion 121A of the housing body 100 is preferably formed in correspondence with the rod portion 420. Further, in the embodiment described above, a case in which the arc-extinguishing region R2 in the cylindrical space 13 of the housing 10 is formed including the first arc-extinguishing region R21 and the second arc-extinguishing region R22 having different transverse cross-sectional areas is described as an example, but the mode is not limited thereto. For example, the transverse cross-sectional area of the arc-extinguishing region R2 in the vertical direction may be constant.

Electric Circuit Interruption Test

Figure 9:
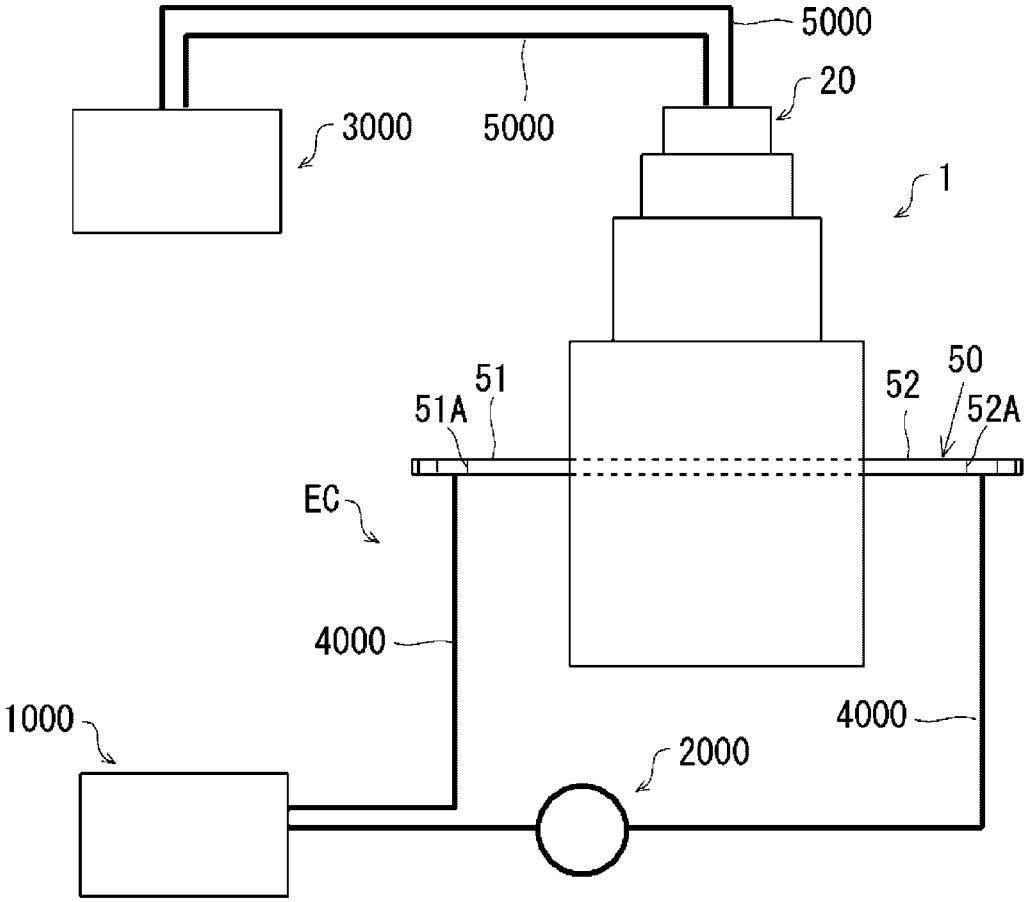
FIG. 9 is a diagram schematically illustrating a testing device used in an electric circuit interruption test.

Next, an electric circuit interruption test performed on the breaker device 1 will be described. FIG. 9 is a diagram schematically illustrating a testing device used in an electric circuit interruption test. Reference sign 1000 denotes a power source, reference sign 2000 denotes an ammeter, and reference sign 3000 denotes an actuation power source. Further, reference sign 4000 denotes wiring for forming an electric circuit EC in cooperation with the conductor piece 50 of the breaker device 1. Further, reference sign 5000 denotes wiring for causing an actuation current supplied from the actuation power source 3000 to flow to the conduction pin 23 (refer to FIG. 1) of the igniter 20 of the breaker device 1.

Next, the steps of the electric circuit interruption test will be described.

(Step 1) As illustrated in FIG. 9, the first connecting end portion 51 and the second connecting end portion 52 of the conductor piece 50 of the breaker device 1 are respectively connected to the power source 1000, the ammeter 2000, and the like by the wiring 4000, and the igniter 20 of the breaker device 1 is connected to the actuation power source 3000 by the wiring 5000.

(Step 2) The current from the power source 1000 is caused to flow to the electric circuit EC.

(Step 3) The actuation power source 3000 is turned on and the actuation current is applied to the igniter 20 of the breaker device 1, thereby actuating the igniter 20.

(Step 4) The power source 1000 and the actuation power source 3000 are turned off.

In the interruption test, the value of current flowing to the electric circuit EC was continuously measured by the ammeter 2000 before and after the actuation current was applied to the igniter 20 of the breaker device 1 by the actuation power source 3000. Note that, in the present interruption test, steel wool (example) was used as the fibrous coolant material 14 with which the arc-extinguishing region R2 of the housing 10 of the breaker device 1 is filled. Further, as a comparative example for comparison with the example, a case where a granular zeolite was disposed in the arc-distinguishing region R2 as the arc-extinguishing material instead of steel wool was used.

Here, a standard type of steel wool available from Nippon Steel Wool Co., Ltd. (trade name: Bonstar, standard wire diameter: φ0.035 mm) was used. Further, in the comparative example, a granular zeolite available from Tosoh Corporation (trade name: Zeoram) was used.

Figure 10:
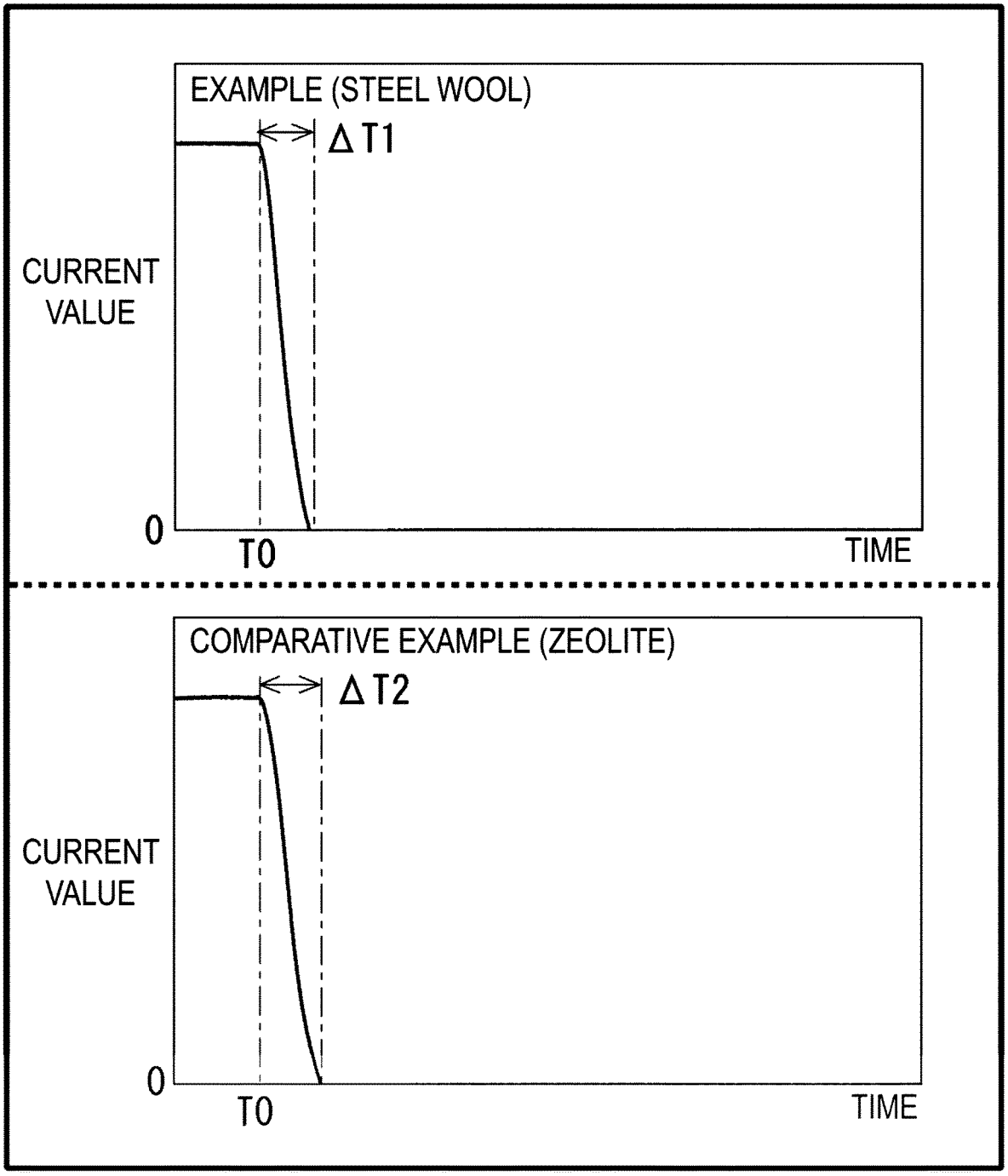
FIG. 10 shows graphs of results of the electric circuit interruption test.

FIG. 10 shows graphs of results of the electric circuit interruption test. The test results of the example and the comparative example are shown in the upper half and the lower half, respectively. In each graph, the vertical axis indicates the current value and the horizontal axis indicates time. Time T0 indicates the time when the actuation power source 3000 was turned on and the actuation current was applied to the igniter 20.

The example using steel wool as the arc-extinguishing material (upper half of FIG. 10) and the comparative example using a granular zeolite as the arc-extinguishing material (lower half of FIG. 10) both rapidly reduced the value of current flowing through the electric circuit EC to zero after actuation of the igniter 20 at time T0. This is conceivably due to the arc being quickly extinguished by the arc-extinguishing materials used in the example and the comparative example. ΔT1 shown in the upper half of FIG. 10 indicates the time required from time T0 until the value of current flowing through the electric circuit EC reached zero (hereinafter referred to as "arc-extinguishing time") in the example. Further, ΔT2 shown in the lower half of FIG. 10 indicates the arc-extinguishing time in the comparative example.

Here, it was found that the arc-extinguishing time ΔT1 in the example is slightly shorter than the arc-extinguishing time ΔT2 in the comparative example. Accordingly, based on the results of the present interruption test, it was confirmed that the example using steel wool as the arc-extinguishing material has at least the same or higher arc-extinguishing performance as that of the comparative example using the granular zeolite as the arc-extinguishing material. Note that, as described above, an arc-extinguishing material having a fibrous form such as steel wool has a different technical effect that cannot be obtained by the granular or powdered arc-extinguishing material.

While the embodiments and modifications of the electric circuit breaker device according to the present disclosure have been described above, the embodiments and modifications described above can be combined to the extent possible.

REFERENCE SIGNS LIST

1 Breaker device
10 Housing
13 Cylindrical space
14 Fibrous coolant material
20 Igniter
30 Cylinder
40 Projectile
50 Conductor piece
53 Cutoff portion

The invention claimed is:

1. An electric circuit breaker device comprising:

an igniter provided to a housing;

a projectile disposed in a cylindrical space formed in the housing, the projectile being movably formed in the cylindrical space by energy received from the igniter;

a conductor piece that is provided to the housing, forms a portion of an electric circuit, includes a cutoff portion to be cut off by the projectile in a portion thereof, and is disposed with the cutoff portion crossing the cylindrical space;

an arc-extinguishing region positioned within the cylindrical space, on a side opposite to the projectile with respect to the cutoff portion prior to activation of the igniter, and configured to receive the cutoff portion cut off by the projectile; and a coolant material having a fibrous form and disposed in the arc-extinguishing region, the coolant material receiving the cutoff portion cut off by the projectile, removing thermal energy of arc generated between the cutoff portion and a remaining conductor piece, and cooling the cutoff portion.

2. The electric circuit breaker device according to claim 1, wherein the coolant material is formed from a metal fiber material.

3. The electric circuit breaker device according to claim 2, wherein the coolant material is formed from steel wool.

4. The electric circuit breaker device according to claim 1, wherein the arc-extinguishing region includes a first arc-extinguishing region adjacent to the cutoff portion disposed crossing the cylindrical space prior to actuation of the igniter and a second arc-extinguishing region positioned on a side opposite to the cutoff portion with the first arc-extinguishing region interposed between the second arc-extinguishing region and the cutoff portion, the first arc-extinguishing region has a width dimension in a transverse cross-sectional direction that corresponds to a width dimension in a transverse cross-sectional direction of the cutoff portion, and the second arc-extinguishing region has a transverse cross-sectional area greater than a transverse cross-sectional area of the first arc-extinguishing region.

* * * * *